US005577303A

United States Patent [19]

Sacks et al.

[11] Patent Number: 5,577,303

[45] Date of Patent: Nov. 26, 1996

[54] CONNECTOR

[75] Inventors: Michael Sacks, PO Box 456, Manchester, M60 2LL; Islah Z. Ali, Shrewsbury; David F. Clark, Madeley, all of United Kingdom

[73] Assignee: Michael Sacks, Manchester, United Kingdom

[21] Appl. No.: 488,501

[22] Filed: Jun. 9, 1995

[30] Foreign Application Priority Data

| | | | |
|---|---|---|---|
| Jun. 9, 1994 | [GB] | United Kingdom | 9411597 |
| Jan. 18, 1995 | [GB] | United Kingdom | 9500960 |
| Apr. 19, 1995 | [GB] | United Kingdom | 9507955 |

[51] Int. Cl.[6] ..... A44B 11/00; A45F 5/00

[52] U.S. Cl. ..... 24/573.1; 24/3.1; 24/297; 24/585; 411/85

[58] Field of Search ..... 24/573.1, 297, 24/585, 662, 324; 411/84, 85

[56] References Cited

U.S. PATENT DOCUMENTS

| | | | |
|---|---|---|---|
| 1,519,380 | 12/1924 | Kochanski . | |
| 1,786,943 | 12/1930 | Gammell | 24/585 |
| 3,385,299 | 5/1968 | Le Roy | 24/585 |
| 3,878,589 | 4/1975 | Schaefer . | |
| 4,393,554 | 7/1983 | Wier . | |
| 4,419,794 | 12/1983 | Horton, Jr. et al. . | |
| 4,605,335 | 8/1986 | Otrusina . | |
| 4,676,420 | 6/1987 | Sharp . | |
| 4,677,716 | 7/1987 | Monsigny . | |
| 4,703,542 | 11/1987 | Hirata et al. . | |
| 4,718,586 | 1/1988 | Hagino . | |
| 4,895,484 | 1/1990 | Wilcox | 411/85 |
| 5,054,170 | 10/1991 | Otrusina . | |
| 5,110,650 | 5/1992 | Kessler | 24/297 |
| 5,271,586 | 12/1993 | Schmidt | 411/85 |

FOREIGN PATENT DOCUMENTS

| | | |
|---|---|---|
| 1581690 | 7/1977 | United Kingdom . |
| 1498655 | 1/1978 | United Kingdom . |
| 2152575 | 8/1985 | United Kingdom . |
| 2165737 | 4/1986 | United Kingdom . |
| 2193995 | 2/1988 | United Kingdom . |
| 2205352 | 12/1988 | United Kingdom . |
| 2249468 | 5/1992 | United Kingdom . |
| 2250054 | 5/1992 | United Kingdom . |
| 2264039 | 8/1993 | United Kingdom . |

*Primary Examiner*—Victor N. Sakran
*Attorney, Agent, or Firm*—Banner & Witcoff, Ltd.

[57] ABSTRACT

A connector for supporting an object engages channels 4 in a track 1. The connector is retained laterally and guided longitudinally thereon. A locking element located between connector and track is moveable longitudinally to effect a locking\unlocking action. An object 40 to be supported is secured to one part 36 of a two-part connector in which the two parts have a quick-attach fastening 32,42 between them. One part 5 is connected to the track 1 and the other part 36 is connected to the object 40. The quick-attach fastening comprises a spring detent 44 and release button 7.

37 Claims, 5 Drawing Sheets

CONNECTOR

The present invention relates to a connector for supporting an object, for example, for releasably attaching an object to a garment.

On military garments such as jackets, there is often a requirement for various objects to be carried such as ammunition, water containers, packs, pouches and the like. This is usually achieved with the aid of specially constructed pockets or loops formed in the garment and/or with the aid of attached webbing. However, with these known arrangements, it is difficult to ensure that a wide range of different objects can be securely and comfortably carried using simple yet robust carrying means. This is especially the case where adjustability of the carrying position is important since this usually requires inconvenient webbing arrangements to be used.

British patent application GB-A-2264039 discloses a connector assembly comprising an elongate track which is connected to a garment and a connector slidably retained on the track and adapted to support an object. The track is formed with two longitudinally extending channels, and the connector has two resilient lips which are deflected and resiliently engage these channels as the connector is forced laterally into engagement with the track.

It is also known from U.S. Pat. No. 5,054,170 to provide a two-part connector for mounting an object on a base, the connector comprising a female part and a male part. The female part includes a recess into which a detent member extends. The male part basically comprises an outwardly-projecting rotatable button which slots into the recess so as to be held by the detent member. In use, the button might turn to a position in which it will slip from the recess causing the two parts of the connector to be disengaged unintentionally.

The present invention is defined in the claims to which reference should now be made.

The present invention in its first aspect provides a connector for supporting an object and which is connectable to, and preferably adjustable along, an elongate track which comprises a pair of tracks extending longitudinally by engagement with said pair of channels so as to be retained laterally and preferably guided longitudinally thereon, the connector having a locking device adapted to cooperate with the track and lock the connector in position, said locking device being located between the connector and the track, and being moveable longitudinally relative to the connector to effect a locking and unlocking action with the track.

It will be seen that in its preferred embodiments the invention provides a simple, robust and controllable support.

Preferably, the locking device is separable from the connector, and is assembled with the connector so as to be held in place between the connector and track when the connector is engaged with the track. The locking device preferably has locking surfaces which move laterally to engage or disengage side walls of a longitudinal recess in the track when the locking device is moved longitudinally to effect a locking or unlocking action.

The locking surfaces are biased apart by at least one resilient arm of the locking device to provide a locking action, each resilient arm including a press portion which is moveable longitudinally of the track to bend the arm to effect an unlocking action.

The locking device is alternatively slidable longitudinally in the recess between a locking position and an unlocking position.

The present invention in its second aspect provides a releasable connector for supporting an object on a base, comprising a female part, a male part and a slide member, the female part comprising a recess and a detent, the detent being biased so as to extend into the recess, the male part being adapted to be inserted into the recess of the female part, and cooperate with the detent so as to be held thereby, and the slide-member being operable to engage the detent so as to move it out of the recess thereby to release the male part from the female part.

The male part of the connector is preferably formed with an aperture in which the detent engages and abuts the rim thereof so as to secure the two parts together. The connector is released by operation of the slide-member acting on the detent which is spring-biased into the recess. The slide-member engages a sloping side of the detent to move the detent out of the recess against its biasing. The male part, which preferably has a flat or tang-like shape, can then be withdrawn from the recess.

Preferred embodiments of the invention will now be described, by way of example, with reference to the drawings in which.

Figure 1:
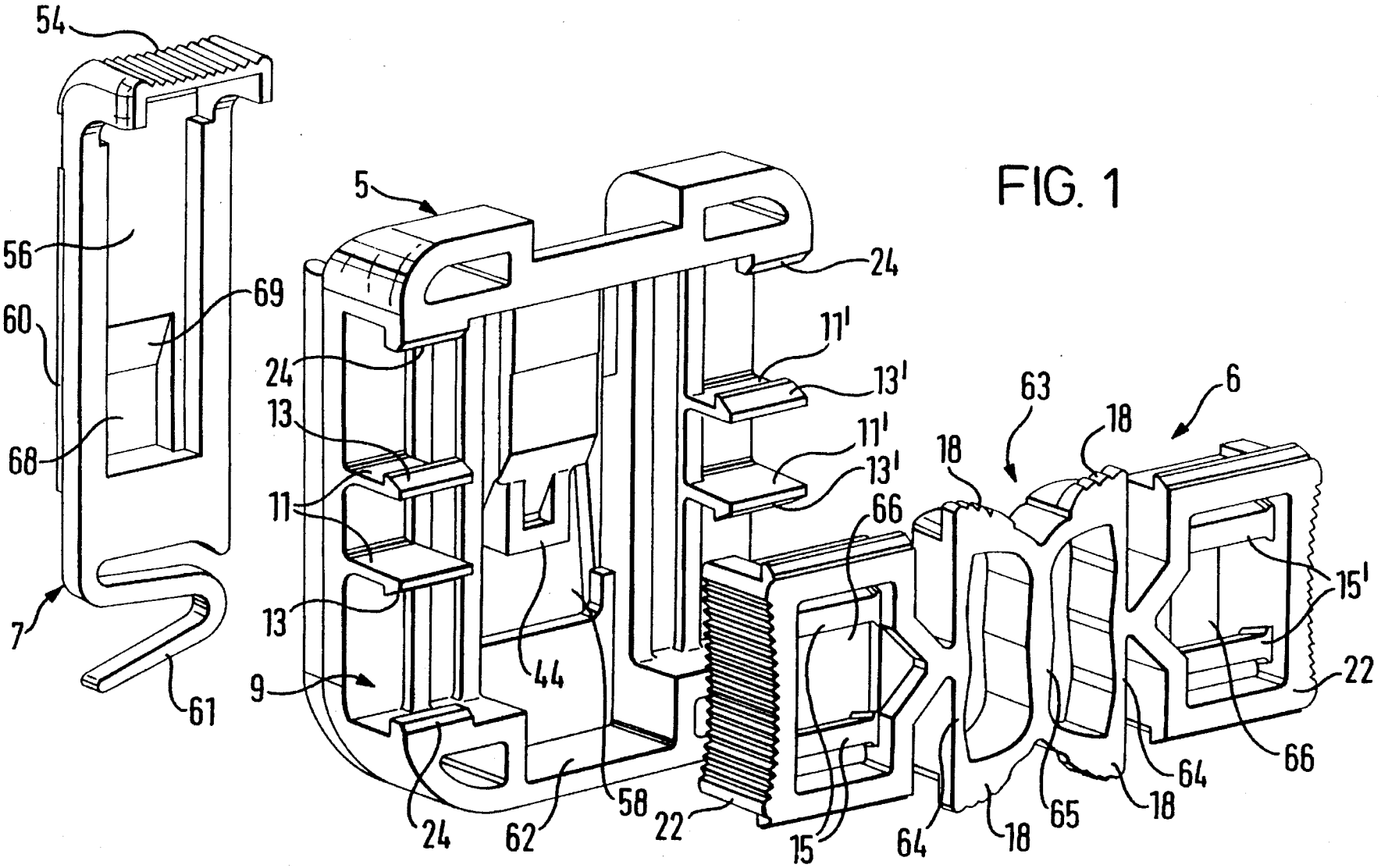
FIG. 1 shows three parts of a connector according to a first embodiment of the invention.

The connectors shown in FIGS. 1 to 7 are adapted to be releasably connected to a track 1 (see FIGS. 3, 5 and 6) comprising a base formed with a pair of longitudinally extending parallel ribs 2. The side walls of the ribs 2 are recessed to define channels 4 running along both sides of each rib 2. The track 1 can be attached to any surface as required to suit a particular application, and may be directed horizontally or vertically or in any other manner. The track can be flexible, for example, for attachment to a garment, or rigid, such as for attachment to a wall.

A preferred connector shown in FIGS. 1 to 5 comprises three components, namely, a main body 5, locking device 6, and a release button 7.

The main body 5 is formed with a transverse recess 9 at its rear to accommodate the locking device 6. Two pairs of detent arms 11, 11' with teeth 13, 13' at their ends, project rearwards into the recess 9 and are a resilient snap fit with edges 15, 15' of corresponding apertures 66 in the locking device so as to hold the two components together. Teeth 24 are also provided on the body 5 along opposite sides of the recess 9 to cooperate with channels 4 of the track 1, as described hereafter.

Figure 2:
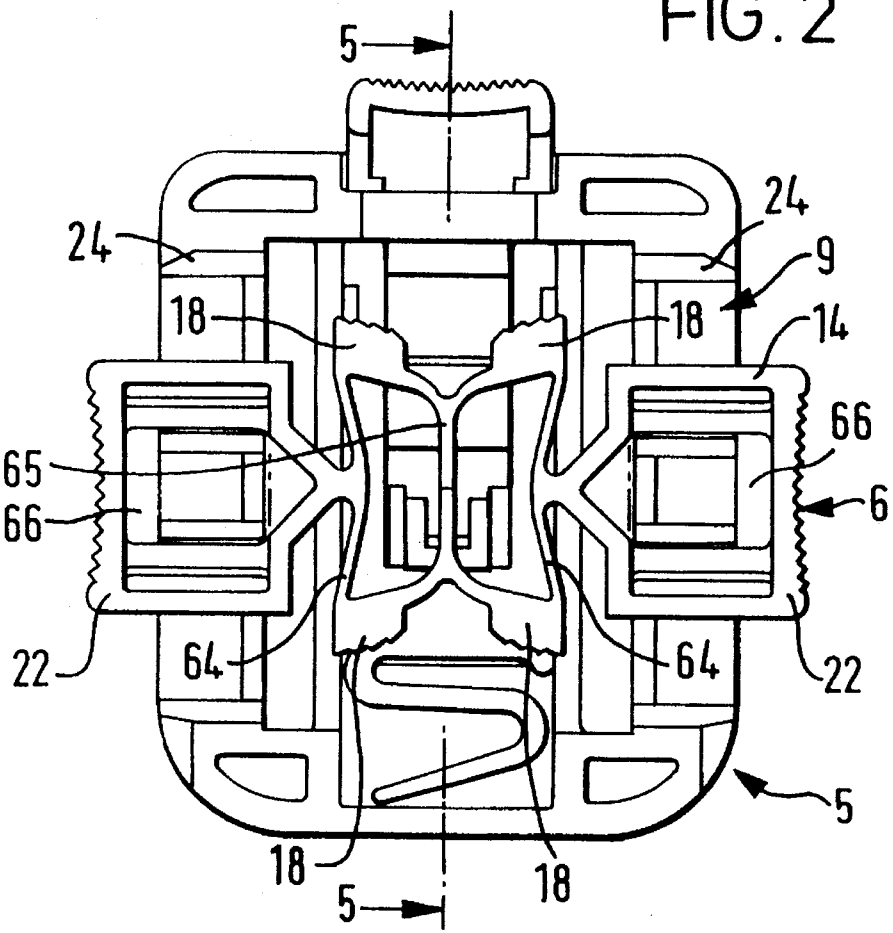
FIG. 2 shows a rear view of the connector of FIG. 1 with the three parts assembled together.
Figure 3:
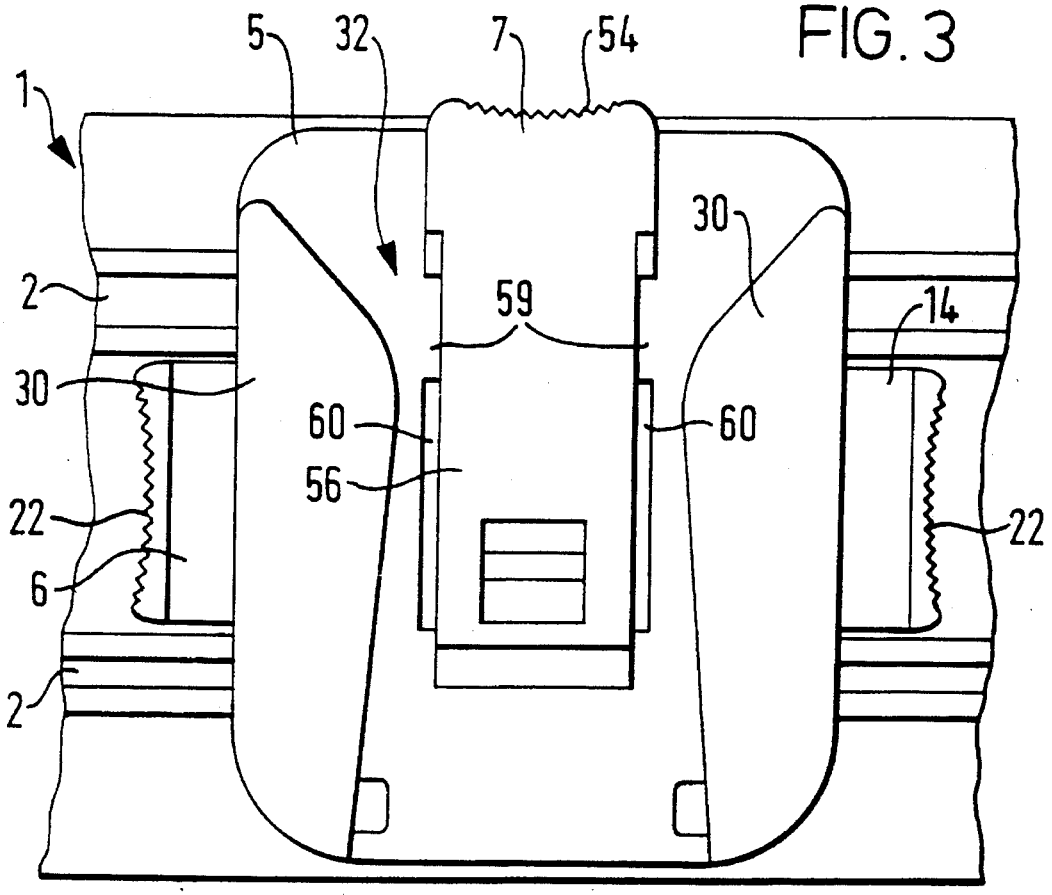
FIG. 3 shows the connector of FIG. 2 connected to a track.
Figure 4:
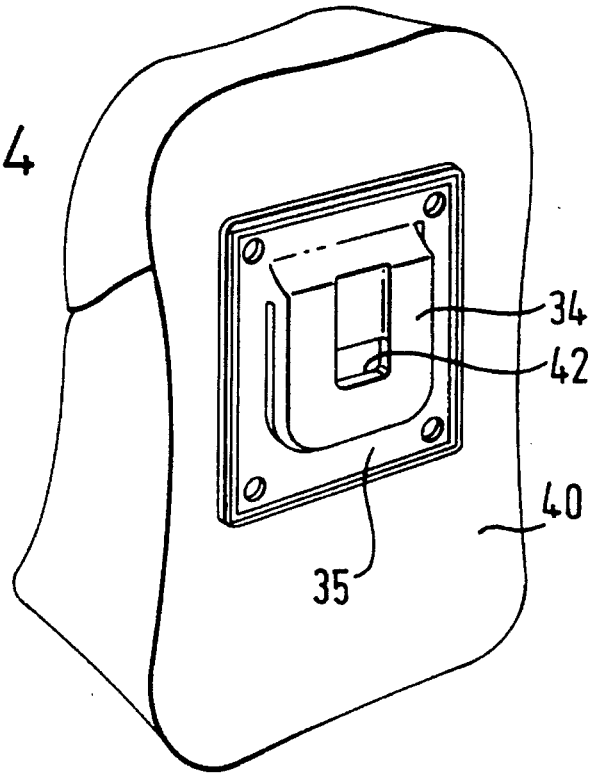
FIG. 4 shows a clip adapted for releasable locking engagement with the connector of FIGS. 1 to 4.

The release button 7 comprises a release bar 56 formed with a press portion 54 at its upper end. The release bar 56 is received as a vertical slide fit in a recess 57 in the front face of the main body 5 which extends downwards from the top about two thirds the height of the body, and opens at its lower end into an aperture 58 through the body 5. Lugs 59 at each side of the recess cooperate with rebates 60 down each edge of the bar 56 to retain the button 7 in the recess 57 as a slide fit. The lower end of the bar 56 extends downwards through the aperture 58 so as to lie behind the body, as shown in FIGS. 2 and 3, and is formed with a U-shaped resilient finger 61 which extends downwards and engages a rearwardly extending shoulder 62 in the body 5. Downwards movement of the button 7 compresses the resilient finger so as to produce a return spring force that returns the button to its upper inoperative position when released, as shown in FIGS. 2 and 3.

As shown in FIGS. 1 and 2, the locking device 6 is a squeeze element 14 having two end portions 22 connected by an intermediate resilient assembly 63 which allows the end portions to be squeezed together along a centre line therebetween. The resilient assembly takes the form of a resiliently deformable framework, symmetrical about the centre line, and having outer resilient walls 64 extending laterally of the centre line to which respective end portions 22 are connected on the centre line so that the walls 64 flex inwards towards one another at their centres when the end portions 22 are squeezed together.

Pairs of locking teeth 18 are connected between the adjacent outer ends of the resilient walls and a central lateral wall 65 so that when the resilient walls 64 are squeezed together the teeth 18 both sides of the centre line move towards one another. That is, the teeth 18 are effectively cantilevered at the ends of the central wall 65 and are pulled inwards when the locking device 6 is squeezed.

The detent arms 11,11' that secure the locking device 6 to the body 2 engage respective apertures 66 in the end portions 22 and are a slide fit with these apertures along the centre line of the locking device 6, so as to allow these end portions 22 to be squeezed together.

Figure 5:
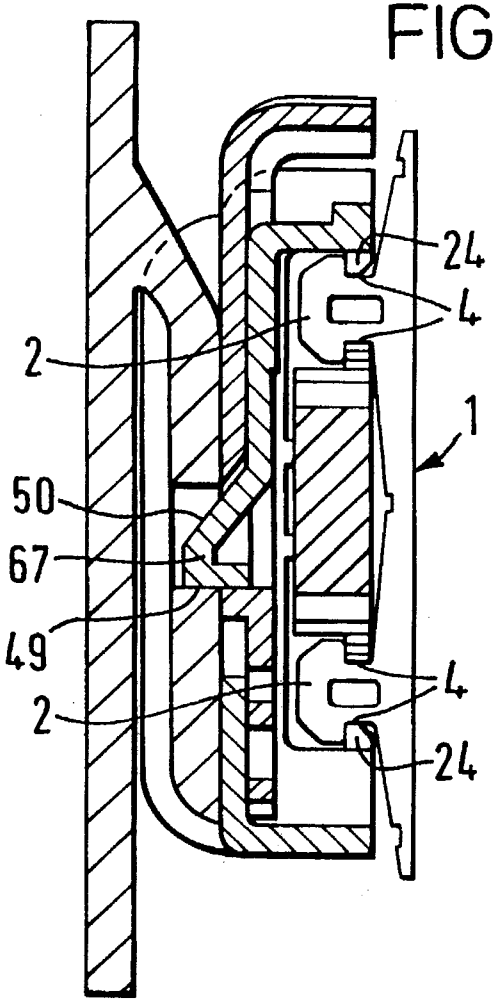
FIG. 5 is a section through the assembly of FIG. 3 showing the interconnection between the connector and the track and the clip of FIG. 4.

The assembled connector is connected to the track 1 from one end of the track by aligning the recess 9 in the rear of the body 5 with the ribs 2 so that the teeth each side of the recess engage the channels 4 in the outer edge of each rib 2. The connector can then be slid onto the track. However, the teeth 18 will project laterally and engage the ends of the ribs 2 to prevent full sliding engagement, until the locking device 6 is squeezed to retract the teeth. Squeezing the locking device 6 is therefore necessary while the connector is slid onto the track and positioned longitudinally. Once this has been done, the locking device 6 is released, and the teeth 18 are urged resiliently outwards to engage in the channels 4 in the inner edge of each rib 9 as shown in FIG. 5. The ends of the teeth 18 are serrated to give an improved gripping action in the base of the channels 4 so that the connector is held against longitudinal sliding movement on the track. If it is required to re-position the connector or remove it from the track, then the locking device 6 is squeezed to allow sliding movement.

As shown in FIG. 3, the main body 5 of the connector includes partially turned-in winged portions 30 on its front face defining a U-shaped recess 32. This recess 32 is adapted to receive a tang 34 of a corresponding male connector 36 shown in FIG. 4. The male connector 36 includes a base plate 35 with holes 26 for fastening it to an object 40 to be supported on the track 1. The tang 34 includes a rectangular aperture 42 for engagement with a resilient detent 44 that projects forwards from the front face of the connector main body 5.

As shown in FIG. 5, the detent 44 is effectively cantilevered along the top edge of the aperture 58 in the body 5 so as to flex rearwards about this edge due to the natural resilience of the plastics material from which it is moulded. The detent 44 is formed with an outwardly and downwardly sloping cam surface 50 which terminates in a nose portion 67 with an undercut abutment surface 49.

The release button 7 is also formed with an aperture 68 in a position to receive the detent 44, and the upper edge 69 of this aperture is inclined outwards and downwards to match the slope of the cam surface 50. When the release button 7 is in the raised inoperative position, shown in FIGS. 3 and 5, the detent 44 projects forwards a maximum extent through the aperture 68 beyond the front face of the release button, and the inclined upper edge 69 of the aperture 68 is located closely adjacent to the cam surface 50 of the detent.

When the tang 34 of the male connector 36 is inserted into the recess 32 of the body 5, the nose 67 of the detent 44 engages in the aperture 42 in the tang, and the lower edge of the aperture 42 locks beneath the undercut abutment surface 49 of the detent, thereby retaining the tang 34 in the recess 32. However, depression of the release button 7 deflects the detent rearwards by engagement with the sloping cam surface 50 of the detent, thereby withdrawing the nose 67 of the detent from the aperture 42 in the tang 34. The tang 34 is therefore released, and can be extracted from the recess 32.

Figure 6:
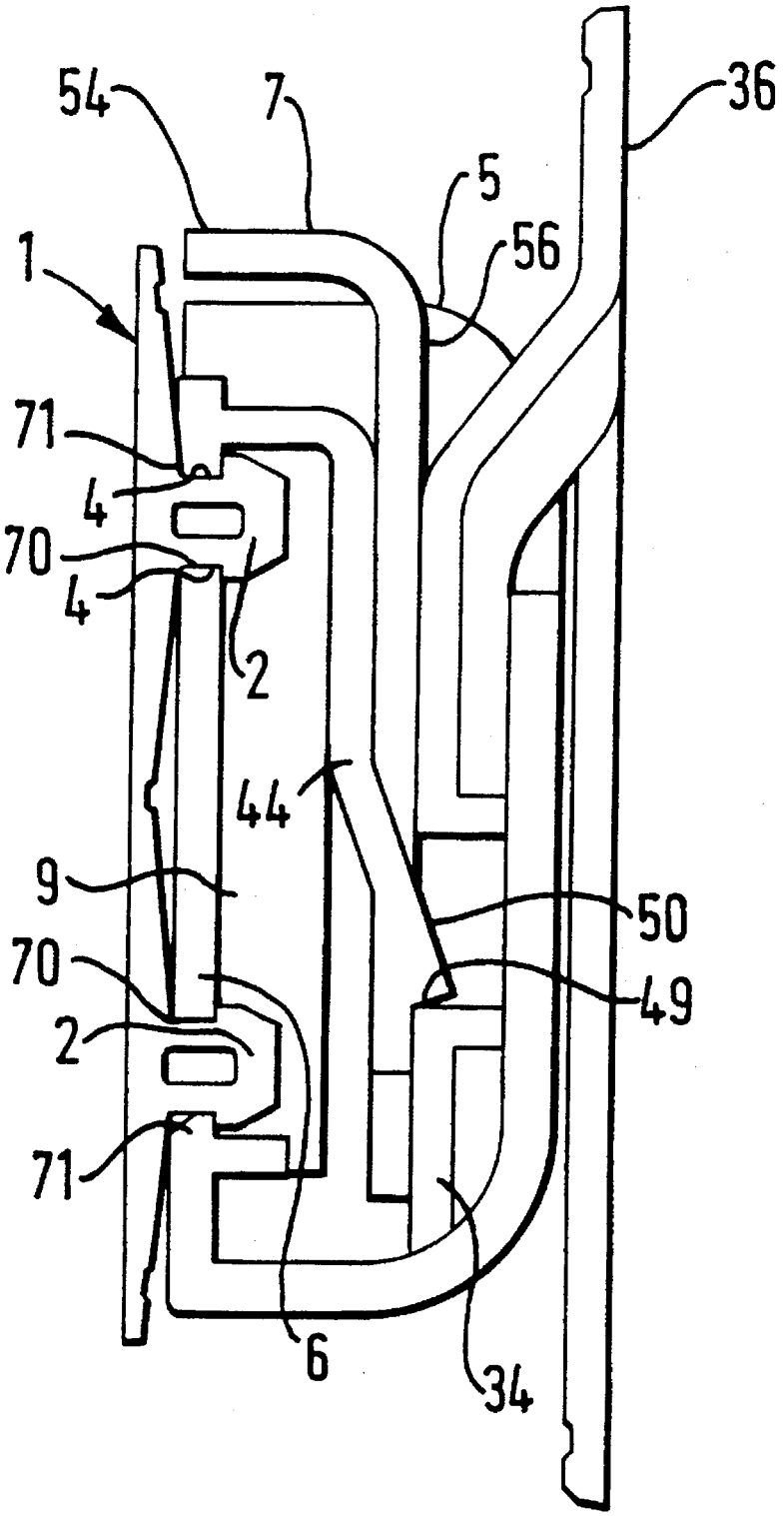
FIG. 6 is a section through a connector according to a second embodiment of the invention as shown connected to a track.
Figure 7:
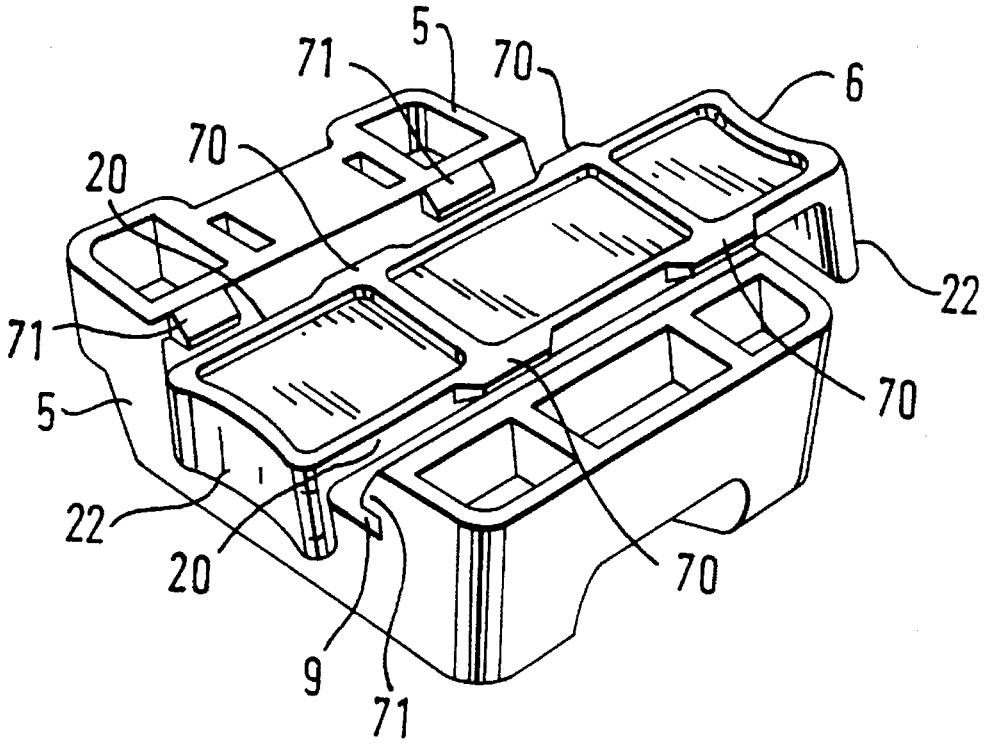
FIG. 7 shows a rear view of the connector of FIG. 6.

In a second preferred embodiment shown in FIGS. 6 and 7, the connector includes a main body 5, and locking device 6 in the form of a slider received in a lateral recess 9 in the rear of the body 5. The slider 6 has a pair of outwardly directed nibs 70 along each of its lateral sides 20, and the main body 5 has a pair of inwardly-directed nibs 71 along each of the lateral edges of the recess 9.

When the connector is fitted to the track 1, each pair of nibs 70 on the slider 6 engage a respective channel 4 on the inner side of the ribs 2, and each pair of nibs 71 on the main body 5 engage a respective channel 4 on the outer side of the ribs 2. The nibs 70 of the slider and nibs 71 of the main body cooperate so that when off-set relative to one another, the connector is slidable along the track, and when aligned relative to one another, the connector is locked in position on the track. As shown in FIG. 6, the oppositely directed pair of nibs 70, 71 when aligned, act to resiliently squeeze the ribs 2 between them. The slider 6 is slid relative to the main body 5 by pressing one way or the other on the ends 22 of the slider. The ends 22 also serve as stops that cooperate with the adjacent sides of the body 5 to limit the relative sliding movement.

In alternative embodiments of the invention, the connector may be a snap fit with the track 1 so that it can be connected to it at any point along its length. The teeth or nibs on the main body 5 may be resilient so as to clip-fit into the channels 4, and in the embodiment of FIGS. 6 and 7, the nibs 70 on the slider 6 may also be a resilient clip-fit in the channels 4.

In other embodiments of the invention, the teeth 24 in the embodiment of FIGS. 1 to 5 may be omitted so that the teeth 18 alone connect the connector to the track 1.

In yet other embodiments of the invention, the track 1 may be a short length to receive the connector in one position only, whether slid on from one end or a clip-fit.

Figure 8:
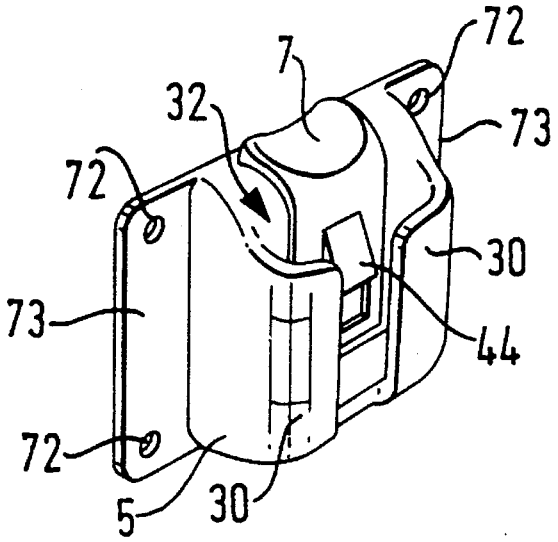
FIG. 8 shows a connector according to a third embodiment of the invention.

In yet other embodiments of the invention, the track 1 and locking device 6 may be omitted, and instead the connector main body 5 may be adapted for connection to a base by bolts or screws through holes 72 in side-flanges 73, as shown in FIG. 8. The connector body 5, release button 7 and cooperating tang 34 would otherwise all be as described above in relation to FIGS. 1 to 5.

The connectors as described above have the advantages of being of simple and robust construction. One or more connectors can be permanently secured to a base via the main body 5 as in the example of FIG. 8, or can be releasably secured to a base via a track 1, as in the examples of FIGS. 1 to 7. Objects to be supported on the base each have a male connector 36 secured to it which is releasably connected to a main body 5 of a connector as shown in FIGS. 5 and 6. The quick-release fastening between the male connector 36 and main body 5 allows easy and rapid connection and disconnection of corresponding objects to the base, and allows objects to be connected to different bases which are provided with corresponding connector main bodies 5. For example ammunition pouches or armaments may be stored in one location using connectors according to the invention, and may be rapidly issued for deployment on the garments or kit of personnel going into action, which garments or kit is similarly provided with suitable connectors. In either location when stored or deployed, the objects may be fixed in position or longitudinally adjustable in position along a track 1.

The connectors can also have .many other applications besides for military or emergency services. For example, objects such as electrical trunking or cabling can be fixed to a wall, with a slidable releasable fastening. Furthermore, meat or other food stuffs can be slidably hung in a cold store or refrigerator.

Furthermore, a connector according to any of the examples given above may be additionally provided with a security feature whereby the normal locking device 6 and/or release button 7 can be rendered inoperable to prevent release of the connector. A security lock would be incorporated in the connector and could be adapted to be unlocked locally or remotely using a key, which could be a mechanical or electronic key. For example, the security lock could be incorporated in the release button 7 and be operated by a key engaged with a corresponding key release mechanism forming part of the security lock in the connector.

We claim:

1. A connector for supporting an object and which is connectable to an elongate track which comprises a pair of channels extending longitudinally, by engagement with said pair of channels so as to be retained laterally thereon, the connector having a locking device cooperating with the track and locking the connector in position, said locking device being located between the connector and the track and having a press portion, said press portion being moveable relative to the connector in a direction parallel to the longitudinal direction of the track to effect a locking and unlocking action between the locking device and the track.

2. A connector according to claim 1, in which the locking device is separable from the connector, and is assembled with the connector so as to be held in place between the connector and track when the connector is engaged with the track.

3. A connector as claimed in claim 2, in which the locking device is a snap-fit with the connector.

4. A connector according to claim 2, in which the locking device is moveable longitudinally relative to the connector between a locking position and an unlocking position.

5. A connector according to claim 4, in which the track comprises a rib, and the connector and the locking device are each formed with lateral projections, said lateral projections engaging respective ones of said channels formed on opposite sides of the rib along the track so as to grip the rib between them and provide said locking action when the locking device is moved longitudinally to said locking position.

6. A connector according to claim 5, in which the track comprises two parallel longitudinally extending ribs formed in the track, there being a recess between two parallel longitudinally extending ribs, the locking device being formed in the recess.

7. A connector according to claim 6, in which each said rib is formed with a pair of said channels, one each on opposite sides thereof, and the connector is formed with first lateral projections said first lateral projections acting to engage each of the laterally outermost channels, and the locking device is provided with second lateral projections, said second lateral projections acting to engage each of the innermost channels, a locking action thereby being achieved by said lateral projections gripping both ribs.

8. A connector according to claim 4, in which the connector is formed with lateral projections, which engage longitudinally extending channels in the track so as to retain the connector on the track independently of whether the locking device is operated to effect said locking action.

9. A connector according to claim 4, in which the track comprises at least one further longitudinally-extending channel and a wall, said further longitudinally-extending channel accommodating at least one laterally projecting portion of the connector, the locking surfaces of the locking device being surfaces of projecting nibs, the locking device being moveable so that at least one said nib is brought into longitudinal alignment with said at least one laterally projecting portion of the connector so as to grip the wall of the track therebetween to fasten the connector at a longitudinal position along the track.

10. A connector according to claim 1, in which the track comprises a longitudinal recess with side walls defining said channels, the locking device being received in said longitudinal recess in the track.

11. A connector according to claim 10, in which the locking device has locking surfaces (18) which move laterally to engage or disengage said side walls of the recess when the locking device is moved longitudinally to effect said locking and unlocking action.

12. A connector according to claim 11, in which the locking device comprises at least one resilient wall, said at least one resilient wall biasing the locking surfaces apart to provide said locking action, and the locking device includes a press portion, said press portion moveable longitudinally of the track to bend the wall to effect said unlocking action.

13. A connector according to claim 12, in which the locking device comprises a pair of resilient bendable walls, each of the resilient bendable walls including a press portion, the two said press portions being squeezable towards each other to bend the walls and effect said unlocking action.

14. A connector according to claim 11, in which the locking surfaces are toothed.

15. A connector as claimed in claim 1 in which the locking device comprises manually operable press portions, said press portions being positioned on opposite sides of the connector and being squeezable towards each other to effect an unlocking action.

16. A connector as claimed in claim 1 in which the locking device serves to retain the connector on the track through said locking action.

17. A connector as claimed in claim 16 in which the locking device engages said pair of channels to retain the connector in the track and to lock its longitudinal position in the track.

18. A combination of a connector as claimed in claim 1 and an elongate track the track being formed with a pair of longitudinally extending channels for engagement by the connector.

19. A combination as claimed in claim 18, and including an object supporting component, said component being connectable to said connector via a quick-release fastening.

20. A combination as claimed in claim 19, in which said quick-release fastening comprises a resiliently biased detent.

21. A connector as claimed in claim 1 further comprising a female part, a male part and a slide member, the female part comprising a recess and a detent, the detent being biased so as to extend into the recess, the male part being inserted into the recess of the female part and cooperating with the detent so as to be held thereby, and the slide-member being operable to engage the detent so as to move it out of the recess, thereby releasing the male part from the female part.

22. A connector according to claim 21, wherein said male part is formed with an aperture in which the detent engages and abuts the rim thereof so as to secure the male and female parts together.

23. A connector according to claim 21, wherein said connector is releasable by the slide-member acting on the detent, which is spring-biased into the recess.

24. A connector according to claim 23 wherein said slide-member acts on a sloping side of the detent to move the detent outwards of the recess against its biasing.

25. A connector according to claim 21, wherein the male part has a tang-like shape.

26. A connector for supporting an object and which is connectable to, and adjustable along, an elongate track which comprises a pair of channels extending longitudinally, by engagement with pair of channels so as to be retained laterally and guided longitudinally thereon, the connector having a locking device cooperating with the track and locking the connector in position longitudinally, said locking device being located between the connector and the track, and having a press portion, said press portion being moveable relative to the connector in a direction parallel to the longitudinal direction of the track to effect a locking and unlocking action between the locking device and the track.

27. A connector according to claim 26, in which the locking device is separable from the connector, and is assembled with the connector so as to be held in place between the connector and track when the connector is engaged with the track.

28. A connector according to claim 26, in which the track comprises a longitudinal recess with side walls defining said channels, the locking device being received in said longitudinal recess in the track.

29. A connector as claimed in claim 26, in which the locking device comprises manually operable press portions, said press portions being positioned on opposite sides of the connector and being squeezable towards each other to effect an unlocking action.

30. A connector as claimed in claim 26, in which the locking device serves to retain the connector on the track through said locking action.

31. A combination of a connector as claimed in claim 26 and an elongate track the track being formed with a pair of longitudinally extending channels for engagement by the connector.

32. In a support assembly comprising an elongate track having a pair of channels extending longitudinally, a connector for supporting an object and which is connectable to the track by engagement with said pair of channels so as to be retained laterally thereon, the connector having a locking device locking the connector in position on the track, the locking device being located between the connector and track, and having a press portion, said press portion being movable relative to the connector in a direction parallel to the longitudinal direction of the track to effect a locking and unlocking action between the locking device and the track.

33. In a support assembly comprising an elongate track having a pair of channels extending longitudinally, a connector for supporting an object and which is connectable to, and adjustable along, the track by engagement with said pair of channels so as to be retained laterally and guided longitudinally thereon, the connector having a locking device locking the connector in position longitudinally on the track, the locking device being located between the connector and track, and having a press portion, said press portion being moveable relative to the connector in a direction parallel to the longitudinal direction of the track to effect a locking and unlocking action between the locking device and the track.

34. A connector for supporting an object and which is connectable to an elongate track which comprises a pair of channels extending longitudinally, by engagement with said pair of channels so as to be retained laterally thereon, the connector having a locking device cooperating with the track and locking the connector in position, said locking device being located between the connector and the track, and being moveable longitudinally relative to the connector to effect a locking and unlocking action with the track, the locking device being separable from the connector, and being assembled with the connector so as to be held in place between the connector and track when the connector is engaged with the track, the locking device being moveable longitudinally relative to the connector between a locking position and an unlocking position, the track comprising a rib, and the connector and the locking device are each formed with lateral projections, said lateral projections engaging respective ones of said channels formed on opposite sides of the rib along the track so as to grip the rib between them and provide said locking action when the locking device is moved longitudinally to said locking position.

35. A connector according to claim 34, wherein the track comprises two parallel longitudinally extending ribs formed in the track, there being a recess between two parallel longitudinally extending ribs, the locking device being formed in the recess.

36. A connector according to claim 35, wherein each said rib is formed with a pair of said channels, one each on opposite sides thereof, and the connector is formed with first lateral projections said first lateral projections acting to engage each of the laterally outermost channels, and the locking device is provided with second lateral projections, said second lateral projections acting to engage each of the innermost channels, a locking action thereby being achieved by said lateral projections gripping both ribs.

37. A connector for supporting an object and which is connectable to an elongate track which comprises a pair of channels extending longitudinally, by engagement with said pair of channels so as to be retained laterally thereon, the connector having a locking device cooperating with the track and locking the connector in position, said locking device being located between the connector and the track, and being moveable longitudinally relative to the connector to effect a locking and unlocking action with the track, the locking device being separable from the connector, and being assembled with the connector so as to be held in place between the connector and track when the connector is engaged with the track, the locking device being moveable longitudinally relative to the connector between a locking position and an unlocking position, the track comprising at least one further longitudinally-extending channel and a wall, said further longitudinally-extending channel accommodating at least one laterally projecting portion of the connector, the locking surfaces of the locking device being surfaces of projections, the locking device being moveable so that at least one said projection is brought into longitudinal alignment with said at least one laterally projecting portion of the connector so as to grip the wall of the track therebetween to fasten the connector at a longitudinally position along the track.

* * * * *

UNITED STATES PATENT AND TRADEMARK OFFICE

CERTIFICATE OF CORRECTION

PATENT NO. : 5,577,303
DATED : November 26, 1996
INVENTOR(S) : Michael Sacks, Islah Z. Ali, and David F. Clark It is certified that error appears in the above-indentified patent and that said Letters Patent is hereby corrected as shown below:

On the title page, item [54] and Col. 1, line 2;

Please change the title from "Connector" to read --A Connector For Supporting An Object Along An Elongated Track--.

Signed and Sealed this

Eleventh Day of February, 1997

Bruce Lehman

*Attest:*

BRUCE LEHMAN

*Attesting Officer*

*Commissioner of Patents and Trademarks*